US009573858B1

(12) United States Patent
Brothers

(10) Patent No.: US 9,573,858 B1
(45) Date of Patent: Feb. 21, 2017

(54) ENERGETIC MATERIALS USING AMORPHOUS METALS AND METAL ALLOYS

(75) Inventor: Alan H. Brothers, Melbourne, FL (US)

(73) Assignee: Energetic Materials Using Amorphous Metals and Metal Alloys

( * ) Notice: Subject to any disclaimer, the term of this patent is extended or adjusted under 35 U.S.C. 154(b) by 1127 days.

(21) Appl. No.: 12/731,295

(22) Filed: Mar. 25, 2010

(51) Int. Cl.
*F42B 12/44* (2006.01)
*C06B 47/10* (2006.01)

(52) U.S. Cl.
CPC ..... *C06B 47/10* (2013.01); *F42B 12/44* (2013.01)

(58) Field of Classification Search
CPC ..... C06B 33/00; C06B 33/06; C06B 29/00
USPC ..... 102/473
See application file for complete search history.

(56) References Cited

U.S. PATENT DOCUMENTS 2,958,277 A * 11/1960 Snelling ..... F42B 12/44 102/364
3,770,524 A * 11/1973 Walker et al. ..... 149/19.5
3,967,989 A * 7/1976 Hawthorne ..... C06B 47/10 149/19.2
4,632,714 A 12/1986 Abegg et al.
4,964,927 A 10/1990 Shiflet et al.
5,266,132 A 11/1993 Danen et al.
5,547,525 A 8/1996 Bennett et al.
5,625,165 A 4/1997 Wight et al.
5,886,293 A 3/1999 Nauflett et al.
6,446,558 B1 * 9/2002 Peker et al. ..... 102/306
6,593,410 B2 7/2003 Nielson et al.
7,524,355 B2 * 4/2009 Dreizin et al. ..... 75/375
2005/0011395 A1 * 1/2005 Langan et al. ..... 102/476
2007/0277914 A1 12/2007 Hugus et al.
2010/0032064 A1 * 2/2010 Dreizin et al. ..... 149/37
2010/0193093 A1 * 8/2010 Coffey et al. ..... 149/15

OTHER PUBLICATIONS

Inoue, Acta Materialia 48 pp. 279-306 (2000).
Dreszin, Progress in Energy and Combustion Science 35 pp. 141-167 (2009).
Ei-Eskandarany and Inoue, Metallurgical and Materials Transactions 37A pp. 2231-2238 (2006).
Lewandowski and Greer, Nature Materials 5 pp. 15-18 (2006).
Air Force Research Laboratory, Richards et al, AFRL/MNME: Eglin AFB, FL, 2004).
Osborne, Mechanical Engineering, Texax Tech University, Lubbock, TX, 2006.

* cited by examiner

*Primary Examiner* — Aileen B Felton

(57) ABSTRACT

A method for improving the characteristics of energetic materials uses amorphous metals as one or more reactant of said materials. Improvements in properties and energy release characteristics for a wide range of energetic materials are obtained thereby, particularly in terms of processability, mechanical properties, and ignition behavior for solid energetic materials.

9 Claims, 1 Drawing Sheet

Amorphous

Crystalline

ENERGETIC MATERIALS USING AMORPHOUS METALS AND METAL ALLOYS

BACKGROUND AND SUMMARY OF THE INVENTION

The present invention relates to energetic materials, also referred to as reactive materials, particularly to improvements in the energy release rate, energy density, mechanical properties, processability, and related properties thereof by substituting substantially amorphous metal alloys for the conventionally used crystalline metal alloys.

Energetic materials, also called reactive materials, are those that release significant amounts of energy in response to an external stimulus, through chemical reactions taking place within the material and/or between the material and its environment. Examples of energetic materials include fuels, propellants, pyrotechnics, and explosives.

The chemical reactions commonly associated with energetic materials include combustion, pyrolysis, thermite, and intermetallic synthesis reactions, as well as combinations thereof. Depending on the application, energetic materials are chosen to respond to trigger stimuli (e.g. electrical signals, heating, vibration, shock, or impact) by emitting energy in the form of light, heat, pressure, etc.

Among the most common chemical reaction used in energetic materials is the thermite reaction, defined as the transfer of oxygen or halogen atoms from an oxidizer phase to a fuel phase. Commonly used oxidizers include metal oxides like $Fe_2O_3$, $MoO_3$, $MnO_2$, $WO_3$, or CuO, oxidizing salts like permanganates, perchlorates, or carbonates, and fluoropolymers like polytetrafluoroethylene (PTFE or Teflon®) or polyvinylidene difluoride (PVDF). Commonly used fuels include active metals like Al, Mg, Ti, or Zr. The ratio of oxidizer to fuel, often called the equivalence ratio, may vary widely depending on the reactants used and the desired properties. See for instance U.S. Pat. Nos. 5,886,293 and 6,593,410.

Thermites can be used in loose powder form, where the fuel and oxidizer are synthesized as powders and mechanically blended, or as energetic composites, in which the loose powders have been compacted into a load-bearing solid using a combination of heat and mechanical forces. Forming energetic composites can improve volumetric energy density and enable new applications, such as the substitution of thermite composites for inert structural materials in certain munitions. See, for instance, published U.S. Pat. App. No. US 2007/0277914.

In many applications, energetic materials are sought that emit the largest amount of energy in the shortest amount of time. The advent of nanotechnology has enabled finely-controlled energetic material systems wherein the rate-controlling mass transport steps in energy release can be dramatically accelerated by reducing reactant sizes to the nanoscale, promoting more intimate nanoscale mixing, increasing the surface area available for the reaction to occur, and lowering the melting point of the fuel to help the reaction begin earlier during ignition. These so-called nanoenergetic materials have enabled revolutionary improvements in reaction efficiencies, energy release rates, and other useful properties. Nanoenergetic materials based on thermite reactions are often called nanothermites or metastable intermolecular composites (MIC). See, for instance, U.S. Pat. No. 5,266,132.

Nanothermites/MIC have certain drawbacks, however. Notably, high surface areas for ultra-fine fuel and oxidizer phases lead to high reactivity with environmental air, water, and other contaminants, and increased sensitivity to electrostatic discharge (ESD). Fine powders are also greater inhalation hazards, and are more difficult to disperse uniformly and consolidate into dense, strong composites. Methods for achieving high energy release rate without incurring the above performance and composites processing penalties of nanothermites/MIC would be of great value to the art.

Amorphous materials are not entirely unknown in the prior art of energetic materials; however, the amorphous materials employed in the present invention and their use are completely different from prior amorphous materials. For instance, U.S. Pat. No. 5,625,165 teaches the use of amorphous azide, cyclic nitramine, or ozone primary high explosives for reduced sensitivity to mechanical and thermal shock. Those disclosed materials are nitrogen- or oxygen-based molecular explosives and not metal alloys, so their properties are quite different. For instance, amorphous characteristics in those disclosed materials were being investigated to reduce ignition sensitivity to mechanical loading not, as in the present invention, for increased ignition sensitivity which is completely opposite.

U.S. Pat. No. 4,632,714 teaches the use of amorphous salts, not amorphous metals. In particular, amorphous ammonium, alkali, and alkaline earth salts are used as oxidizers, not as fuels. There was no recognition that using nitrogen based amorphous salts as oxidizers also provided the benefits of amorphous metal alloys as fuels. Furthermore the benefits derived from using amorphous metals as fuels in explosives are far different when compared to the benefits of using amorphous salts as oxidizers in explosives.

U.S. Pat. No. 5,547,525 teaches the use of amorphous carbon as an additive to increase electrical conductivity in energetic materials and thereby reduce electrostatic discharge sensitivity; in this case the materials are again distinct from those used in the present invention hereinafter described, and the amorphous carbon was neither a fuel nor an oxidizer, nor even a reactant in the energetic system.

In energetic and nanoenergetic/MIC materials known in the art, the fuel comprises a crystalline metal. The present invention, however, relates to energetic or nanoenergetic materials wherein the fuel comprises a substantially amorphous metal.

The present invention uses amorphous metals as fuels in an energetic mixture or composite and is based on my recognition that the use of the amorphous metal fuels improves the processability, mechanical properties, and energy release characteristics of energetic compositions while also making the resulting amorphous composite energetic composite a usable structural material with safe but usable practical energetic properties.

Other objectives and benefits of the present invention will become apparent to those skilled in the art from the subsequent description, wherein are shown and described the modes currently deemed best suited to carry out the invention. As will become apparent to those skilled in the art, my invention is capable of various other embodiments, which do not depart from the key features of my invention. Accordingly, the drawings and descriptions will be regarded as illustrative in nature and not as restrictive.

DETAILED DESCRIPTION OF THE INVENTION

Figure 1:
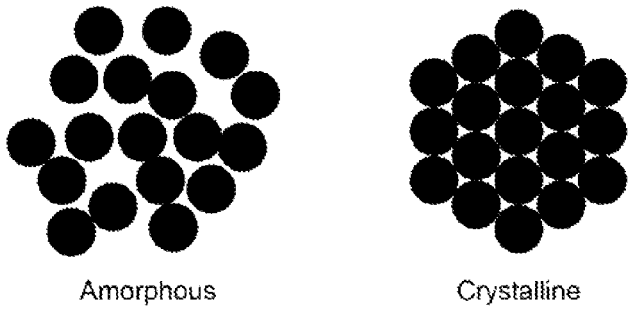
FIG. 1 is a schematic drawing showing a comparison between amorphous and crystalline metals.
Figure 2:
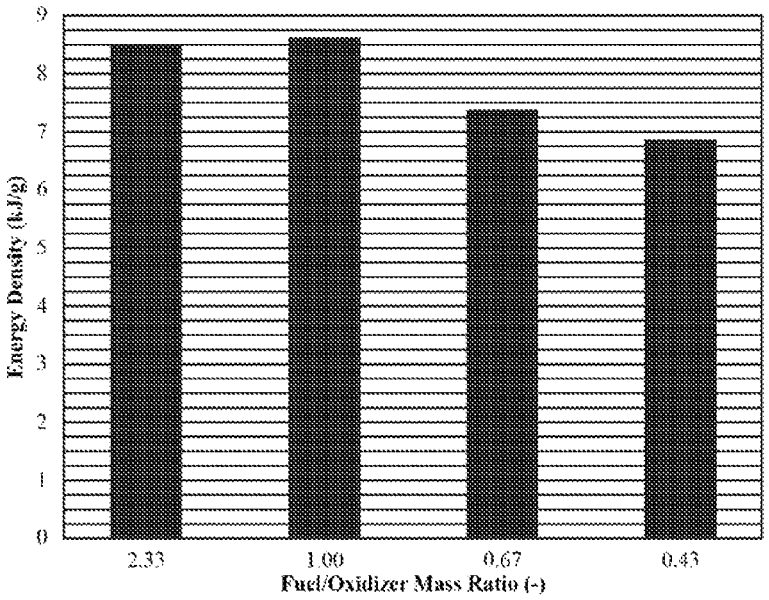
FIG. 2 is a graph showing the heats of reaction ranging between approximately 6.2 J/g and 8.6 J/g for different fuel to oxidizer ratios.

The present invention relates to the replacement of crystalline metals by amorphous metals as fuels within energetic and nanoenergetic materials. Crystalline metals are metals or metal alloys whose atomic structure shows long-range periodicity, i.e. those in which atoms are ordered over large distances. By contrast, amorphous metals or metallic glasses are metals or alloys whose atomic structure shows no periodicity, i.e. those in which atoms are in a disordered, liquid-like state. Effectively all commonly-known metals and alloys are crystalline, including the metals and alloys used in prior thermites and nanothermites, such as Al, Mg, Ti, and Zr and their alloys. The first amorphous metals were produced by Duwez and coworkers in the late 1950s, but it wasn't until the 1990s that the theory and practice of amorphous metals was developed enough to permit widespread application. For an overview of amorphous metals, see Inoue, Acta Materialia 48 pp. 279-306 (2000). For an example of Al-based amorphous metals of the sort that might be used in energetic materials, see U.S. Pat. No. 4,964,927.

Producing an amorphous metal usually begins with alloy design. A set of semiempirical rules exists for designing an alloy that can be made amorphous: (1) there should be more than three metals used in the alloy; (2) the majority metals should have negative heats of mixing among themselves; and (3) they should also have atomic radii differing by at least 12%. Following these rules often leads to alloys near deep eutectic features, i.e. alloys with highly suppressed melting points.

Once an alloy has been designed in this way, it must be carefully processed in order to achieve the amorphous state. Generally this means: (1) use of high-purity metals to avoid impurities that might trigger crystallization; (2) achievement of near-perfect alloying of the metals, either through high-temperature arc or induction melting or high-energy ball milling; and (3) rapid solidification of the alloy, to minimize the time available for crystallization. A high-purity, homogeneous melt that is rapidly solidified can be kinetically 'trapped' in a liquid-like amorphous state using such a process. Because cooling rates during powder spraying and film deposition are quite high, amorphous metals lend themselves naturally to powder and film formats.

In addition to the methods just outlined by way of example, there are other methods of designing and producing amorphous metals and alloys, such as vapor deposition, electrodeposition, mechanical alloying of powders, pressure quenching, etc. In some of these methods, it is possible to produce not only amorphous alloys, but amorphous pure metals. In others, it is possible to produce alloys that are substantially but not entirely amorphous, i.e. that contain crystalline precipitates within an amorphous matrix for the purpose of modifying ductility or other mechanical properties. It will be understood by those skilled in the art that the properties of amorphous materials produced by these various methods, be they alloy or simply metal, and fully or only substantially amorphous, will be quite similar and will exhibit quite similar benefits when compared to energetic materials. Thus the terms "amorphous metal," "amorphous alloy," and "amorphous metal matrix composite" are functionally synonymous for the purposes of this specification.

Because of their unique atomic structure, amorphous metals show unique thermomechanical behavior. Below a certain temperature, known as the glass transition temperature, they are solids. Just above the glass transition temperature, they soften into supercooled liquids (SCL). These supercooled liquids are only metastable, and will crystallize if given sufficient time or temperature. However, good glass-forming alloys can persist as SCL for minutes or more.

I have discovered that this characteristic of amorphous metals offers two advantages for energetic materials. First, amorphous metals liquefy at the glass transition during the reaction, and this leads to faster mass transport in the liquid fuel as well as earlier rupture of the native oxide film that normally inhibits the reaction. The effect of reduced melting point on the performance of thermites and nanothermites is known in the art, see Dreizin, Progress in Energy and Combustion Science 36, pp. 141-167 (2009). However, the melting behavior of amorphous metals is superior for energetic materials because the glass transition temperatures of amorphous metals are well below the melting points of comparable crystalline alloys, often by several hundred degrees, and because melting at the glass transition is independent of particle size and thus does not incur any of the aforementioned processing, safety, or property drawbacks.

Second, the existence of the SCL offers a window in which the fuel may be processed like a normal glass or polymer melt and then cooled back to the amorphous state. An amorphous metal fuel powder can be consolidated into a bulk part, for example, by mechanically pressing it in the SCL state and then cooling it back below the glass transition. While the manufacturing process of SCL consolidation of amorphous powders is generally known in the art, see El-Eskandarany and Inoue, Metallurgical and Materials Transactions 37A, pp. 2231-2238 (2006), this characteristic of amorphous materials has heretofore never been recognized in the fabrication of thermite materials.

I have discovered that a dense energetic composite can be fashioned by blending oxidizers and/or other additives into an amorphous metal fuel powder before pressing. Because of the low temperatures associated with the SCL state, the chance of premature reaction between the oxidizer and amorphous metal fuel is greatly reduced relative to a crystalline fuel; this preserves the energy density of the thermite while greatly reducing manufacturing and handling hazards and significantly lowering the cost of production because cooler, softer powders are less likely to ignite via local overheating or friction.

Figure 3:
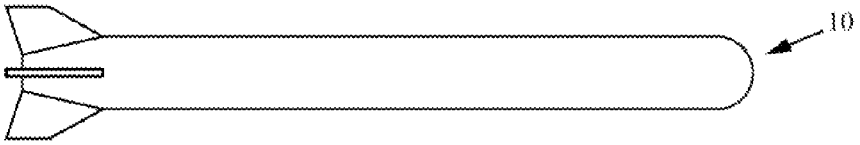
FIG. 3 is a schematic diagram in which the structure of, say, a torpedo consists of energetic material in accordance with the present invention.

I also discovered yet another unanticipated advantage of the use of amorphous fuels, based on their mechanical properties. Crystalline metals deform plastically through the action and interaction of extended crystal defects such as dislocations and grain or subgrain boundaries. The formation and motion of such defects govern such properties as strength and ductility. In amorphous metals, crystalline defects like these are prevented. As a result, amorphous metals have strengths much closer to theoretical limits, and often low ductility. For instance, a typical crystalline Al alloy like Al-6061 might have a yield strength of 100-300 MPa and a tensile failure strain of 10-30%, depending on its temper. A typical amorphous Al alloy might have a yield strength of 800-1200 MPa a tensile failure strain of 1-2%. This lack of grain boundaries and galvanic interactions between discrete phases also renders amorphous metals relatively resistant to corrosion. For this reason, the novel use of amorphous materials as a component of energetic composites, that is made with amorphous metal fuels, results in a energetic composite with higher strength and improved corrosion resistance than would be the case with a comparable energetic composite made with crystalline fuels. This means the amorphous thermite composite can provide structural strength in addition to simply providing energetic properties. This is a significant benefit, since this allows the normally inert materials used for structural purposes to now also have a dual purpose. For example, in lightweight Unmanned Aerial Predator-Type Drones, commonly referred to Unmanned Aerial Vehicles or UAVs, where the structure of the airplane, or even the structure of the propulsion system, serve only to carry the explosive to the target, with the present invention the structure of the airplane itself now also has explosive capability, thereby lowering the weight or increasing the capacity of the UAV, that is increasing the overall energy density of the craft. This, of course, applies to any application ranging from UAVs, missiles, bombs, torpedoes (such as designated by the numeral 10 in FIG. 3), and the like. The present invention thus provides a way to make the necessary structural material of the explosive platform, or the propulsion system, explosive as well, without a decrease in the safety of the system.

I have also discovered a method of making a safer, more stable, less corrosion resistant thermite composite with safer storage, manufacturing and handling characteristics.

As might be expected from the high strength and low ductility, most amorphous metals fail in a brittle manner when loaded. At the microscale, this brittle behavior is caused by propagation of small numbers of shear bands. The intense localized shear deformation within these shear bands leads to rapid, near-adiabatic heating of the surrounding metallic glass. Temperatures in the neighborhood of 3000° C. have been recorded in the vicinity of shear bands, and failure by shear banding is known to cause ejection of hot sparks from fracture surfaces. For a discussion of heating during shear banding, see Lewandowski and Greer, Nature Materials 5 pp. 15-18 (2006). Based on these results, I have discovered that energetic composites formulated with amorphous metal fuels are more prone to formation of 'hot spots' and thus to shear-induced ignition, which allows a more reliable ignition for munitions applications and also allows ignition with lower impact velocities. These are additional unanticipated benefits of using amorphous metal composites for munitions applications.

It should now be apparent to those skilled in the art that the underlying principle of using amorphous metal fuels instead of solely using crystalline metal fuels results in an improved energetic mixture or composite and a practical energetic structural material.

It should also now be apparent to those skilled in the art that the benefits described herein apply for pure metals or alloys having fully amorphous structures or alloys having partially amorphous and partially crystalline structures, and that the benefits of using completely or partially amorphous metal fuels in an energetic composite apply when this fuel is used with any oxidizer. For example, and not to be construed as limiting my invention in any way, the amorphous metal can be combined with solid oxidizers for a thermite reaction, combined with air or oxygen-bearing fluid oxidizers for a pyrotechnic or propellant composition, or combined with other metals or alloys for an intermetallic synthesis reaction.

The present invention is now described further with reference to the following non-limiting example.

EXAMPLE 1

Amorphous aluminum-based powder with approximate composition $Al_{90}Gd_7Ni_2Fe_1$ is prepared by arc melting a mixture of pure elements, followed by gas atomization and sieving. Amorphous-metal-based thermite powders are created by mixing this amorphous metal powder, the fuel, with fine PTFE powder (DuPont Zonyl MP1150™), the oxidizer, in weight ratios from 30:70 to 70:30. The thermite powders are suspended in hexanes and uniformly mixed with the aid of an ultrasonic horn.

The heats of reaction of the amorphous metal/PTFE thermite powders in oxygen at one atmosphere of pressure are measured using bomb calorimetry. A study by the Air Force Research Laboratory (Richards et al. AFRL/MNME: Eglin AFB, FL, 2004) measured the energy density of pure crystalline aluminum/PTFE thermite as 8.77 kJ/g, while another study (Osborne, in *Mechanical Engineering*. Texas Tech University: Lubbock, Tex., 2006) reported a value of 8.42 kJ/g. The energy density of the present amorphous aluminum-based thermite is therefore within ±2.5% of published values for pure aluminum. This was an unanticipated result, especially considering that the amorphous metal was alloyed and thus contained only 90 at % aluminum. This surprising result can be ascribed to the benefits discussed herein, namely improved reaction efficiency/fuel utilization caused by the more rapid melting and mass transport in the amorphous fuel.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An energetic material system, comprising a fuel consisting substantially of at least one reactant of amorphous metal or amorphous metal alloy and which constitutes at least a structural portion of a bullet, shell, missile, bomb, munition, drone or delivery system which incorporates the energetic material system.

2. The energetic material system according to claim 1, wherein the amorphous metal or amorphous metal alloy is selected so as to have a large negative enthalpy of reaction with oxygen or with at least one of fluorine, chlorine and bromine.

3. The energetic material system according to claim 1, wherein the amorphous metal or amorphous metal alloy comprises more than 50 atomic percent of at least one of lithium, beryllium, sodium, magnesium, aluminum, silicon, calcium, scandium, titanium, chromium, yttrium, zirconium, niobium, lanthanum, cerium, gadolinium, hafnium, and tantalum.

4. The energetic material system according to claim 1, wherein said at least one reactant is capable of participating in at least one of a thermite reaction, an intermetallic synthesis reaction and a combustion reaction.

5. The energetic material system according to claim 1, wherein the amorphous metal or amorphous metal alloy is at least one fuel in the energetic material system having an oxidizer and is combinable with the oxidizer.

6. The energetic material system according to claim 5, where the oxidizer is a solid material.

7. The energetic material system according to claim 5, wherein the oxidizer is one of an oxygen-bearing fluid and a halogenated fluid.

8. The energetic material system according to claim 1, further comprising a metal or a nonmetal to be combinable with the amorphous metal or amorphous metal alloy in an intermetallic synthesis reaction.

9. Ammunition device incorporating the energetic material system according to claim 1, wherein the amorphous metal or amorphous metal alloy is selected so as to provide shear-induced ignition.

* * * * *